United States Patent [19]

Larrimore

[11] 4,219,871

[45] Aug. 26, 1980

[54] HIGH INTENSITY NAVIGATION LIGHT

[75] Inventor: Herbert Larrimore, Panama City, Fla.

[73] Assignee: The United States of America as represented by the Secretary of the Navy, Washington, D.C.

[21] Appl. No.: 908,350

[22] Filed: May 22, 1978

[51] Int. Cl.[3] ..... F21V 29/00

[52] U.S. Cl. ..... 362/264; 362/267; 362/294; 362/373

[58] Field of Search ..... 362/261, 263, 363, 264, 362/294, 373, 804, 35, 62, 145, 267

[56] References Cited

U.S. PATENT DOCUMENTS

| | | | |
|---|---|---|---|
| 1,357,559 | 11/1920 | Heilenday | 362/363 |
| 2,288,345 | 6/1942 | DeVry | 362/294 |
| 2,295,339 | 9/1942 | Ericson | 362/294 |
| 3,017,536 | 1/1962 | Irland | 362/261 |
| 3,502,858 | 3/1970 | Håbro | 362/373 |
| 3,684,883 | 8/1972 | Entwistle | 362/294 |
| 3,798,441 | 3/1974 | Wilson | 362/261 |
| 3,936,686 | 2/1976 | Moore | 362/294 |
| 3,949,212 | 4/1976 | Larrimore | 362/263 |
| 4,054,790 | 10/1977 | Slaughter | 362/373 |

*Primary Examiner*—Samuel W. Engle
*Assistant Examiner*—Edward F. Miles
*Attorney, Agent, or Firm*—Richard S. Sciascia; Harvey A. David

[57] ABSTRACT

A high intensity running light fixture capable of submersion to substantial depths includes tungsten-halogen lamps housed in glass globe sealed to a heat dissipating base. The fixture avoids reduction in light transmittance of the globe by the improvement wherein a finned heat collector is disposed in the upper regions of the globe, with fins in close proximity to the inner surface thereof, and is connected by thermally conductive pillars to the base.

10 Claims, 5 Drawing Figures

HIGH INTENSITY NAVIGATION LIGHT

BACKGROUND OF THE INVENTION

This invention relates to shipboard navigation lights for preventing collision at sea, and more particularly to an improved, high intensity, submersible, running light fixture.

Shipboard running lights have generally comprised an electric incandescent lamp housed in a fixture including a lens or globe of colored glass that transmits light of a particular hue or color through a predetermined azimuth sector relative to the head of the vessel. The color, range of visibility, and sector of the lights are stipulated in international rules. Recent changes in the rules have been adopted that require considerably greater visual range of lights and specify candlepower output required for the range. The method used for computing the required output is very conservative and results in values approximately ten times higher than other accepted values.

Attempts to satisfy the new requirements by merely inserting lamps of higher wattage and intensity in existing lamp fixtures have not been satisfactory. In the use of existing port running light fixtures using a red glass globe, for example, the increase in wattage results in considerable increases in operating temperature of the globe, leading to globe fracture upon cooling and, because the percent of light transmittance of the globe is materially decreased with increases in temperature, the required range of visibility is not met. Moreover, increases in operating temperatures are accompanied by shifts in chromaticity of glass globes. In the case of existing green globes that shift is toward the yellow region, and can render the fixtures unacceptable under the new rules. Red glass globes present the greatest challenge because of the great reduction in transmittance that occurs with increases in temperature.

In some arts using high intensity lamp fixtures, it is practical to carry away excess heat by means for ventilating the fixture, forced circulation of a cooling medium, or the like. Shipboard navigation lights, however, are often subjected to spray or immersion. Those intended for use on naval vessels such as submarines are required to withstand submergence to great depths and must be so sealed against water intrusion and free of auxiliary mechanisms that cooling by ventilation or forced circulation of a cooling medium become impractical.

SUMMARY OF THE INVENTION

With the foregoing in mind, it is a principal object of this invention to provide an improved watertight navigation light fixture utilizing a colored glass globe and capable of providing a greater range of visibility than heretofore.

Another object is to provide an improved navigation light fixture of the foregoing character that can be mounted in existing support structure of a vessel and can be operated from existing electrical supply systems.

As another object, the invention aims to provide a high intensity navigation light fixture comprising a combination of a glass globe, a heat dissipating base, and heat collector means disposed adjacent the inner surface of the upper regions of the globe and connected by heat conducting means for transferring the collected heat to the base for dissipation.

Still another object is the provision of such a navigation light that is compact, reliable, inexpensive to manufacture and is easily assembled and dissassembled for service, such as lamp replacement.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
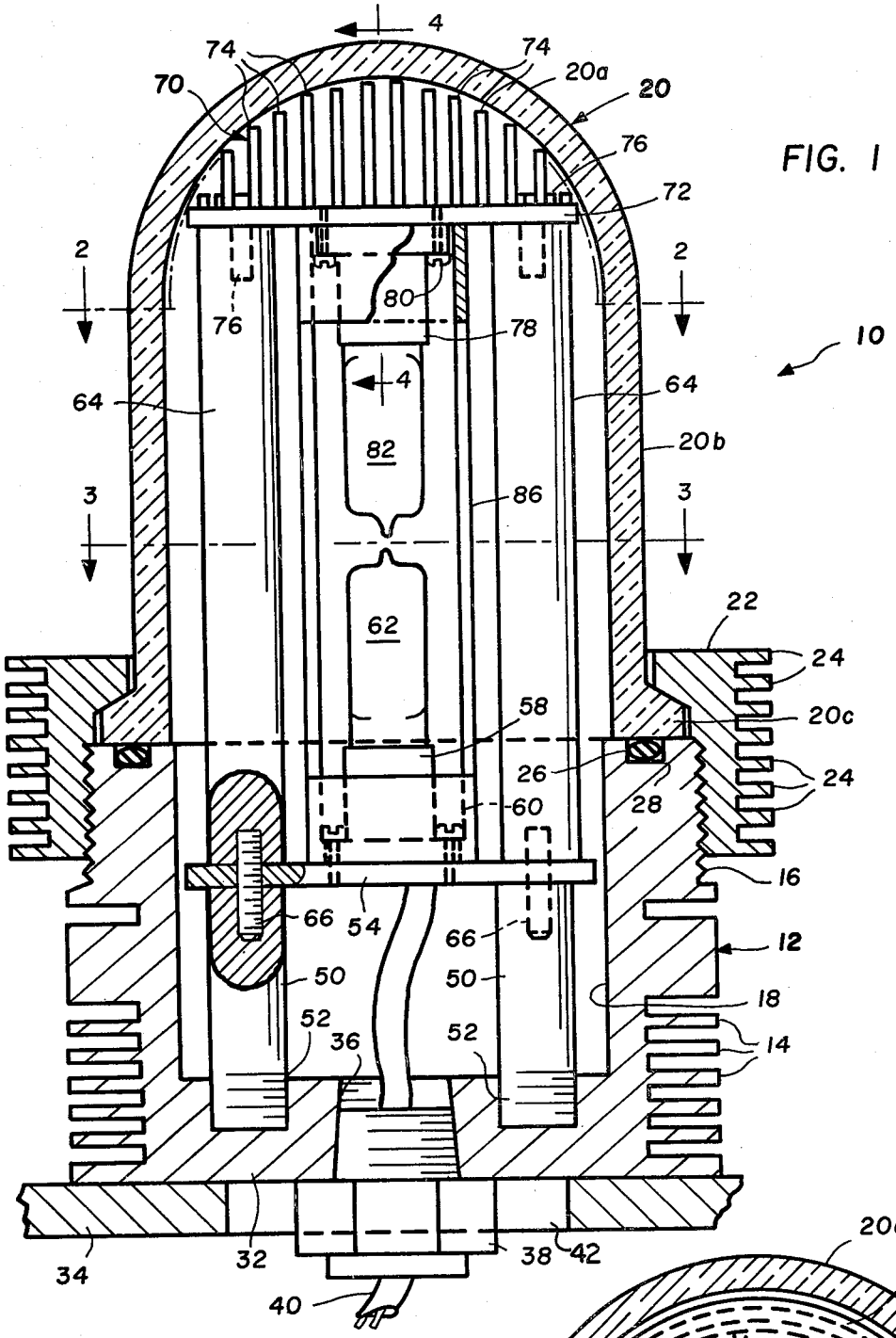
FIG. 1 is a vertical sectional view of an improved navigation light fixture embodying the invention.
Figure 4:
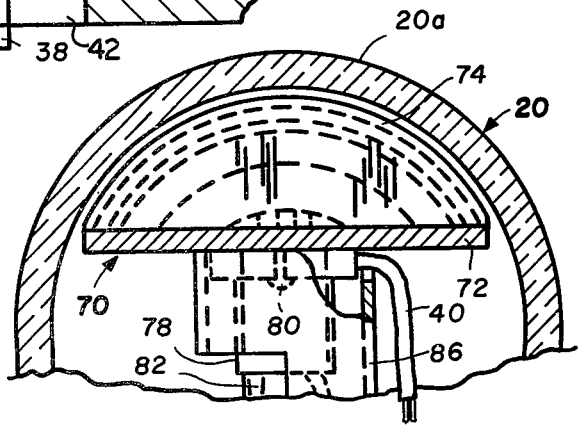
FIG. 4 is a fragmentary sectional view taken substantially along line 4—4 of FIG. 1.
Figure 2:
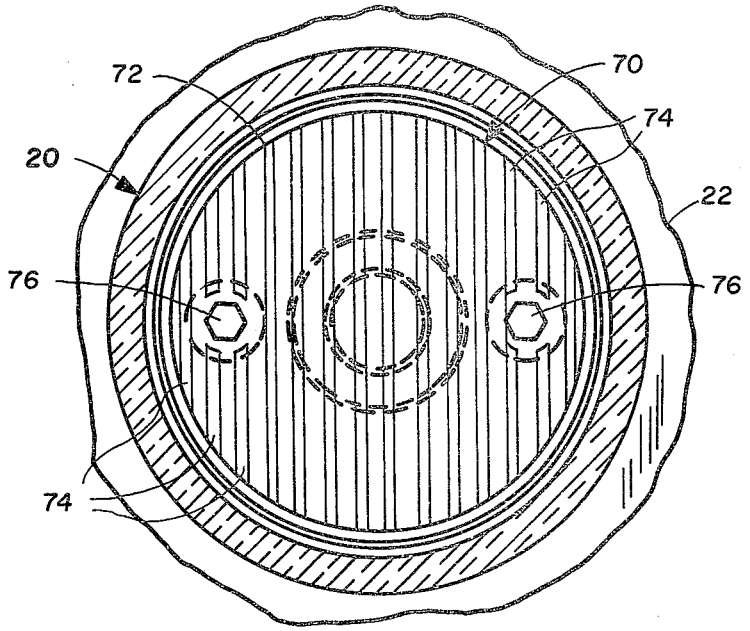
FIG. 2 is a horizontal sectional view taken substantially along line 2—2 of FIG. 1.
Figure 3:
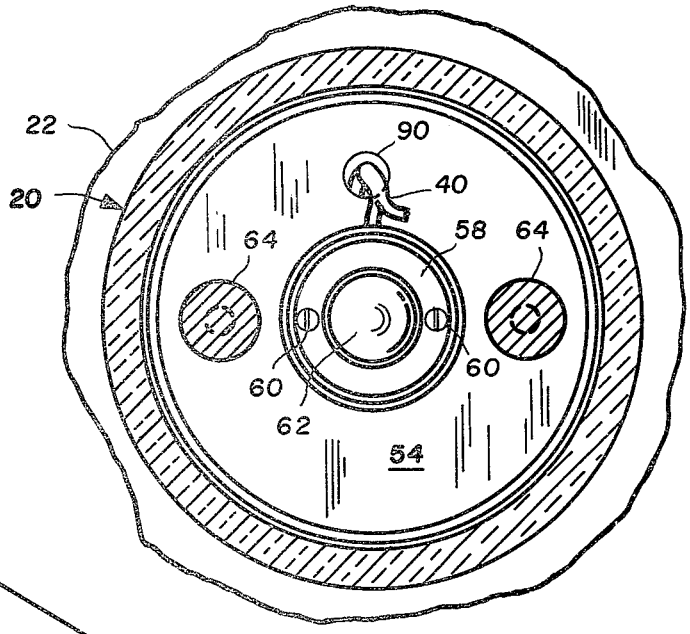
FIG. 3 is a horizontal sectional view taken substantially along line 3—3 of FIG. 1.

The invention will be described with reference to a shipboard navigation light fixture, indicated generally at 10 in FIG. 1. In this example of the invention, the fixture 10 will be considered to be a running light fixture, the purpose of which is to emanate light of predetermind chromaticity, intensity, and sector of visibility, all in accordance with the International Regulations for Preventing Collision at Sea governing the requirements of navigation lights.

The light fixture 10, which by way of example will further be considered to be a port, or red, running light fixture, comprises a generally cup-shaped base member 12 having a plurality of heat dissipating fins 14 around the lower exterior surface thereof, and external threads 16 around the upper exterior surface. The base member 12, which defines a cylindrical cavity 18, is preferably formed of a rigid, corrosion resistant material having good thermal conductivity, such as aluminum.

A light transmitting dome-shaped, glass globe 20, having a hemspherical upper end portion **20*a*, a cylindrical side wall 20*b*, and a peripheral flange 20*c*, is disposed in registration with the upper edge of the base member 12. The globe 20, as will be pointed out later in the discussion of the operation of the fixture, may be of the conventional red glass type used heretofore in running lights. A nut 22, having external heat dissipating fins 24, is threadedly engaged on the base member 12 and cooperates with the flange 20*c* to secure the globe 20 to the base member. A rubber O-ring 26 is disposed in an annular groove 28 in the upper end of the base member 12 and serves to effect a watertight seal between the globe 20 and the base member 12**.

The bottom wall 32 of the base member 12 is of substantial thickness and presents a flat bottom surface adapted to bear against a metal plate 34 forming part of a light fixture support and side board or light shield forming part of the vessel on which the light fixture 10 is used.

An internally threaded opening 36 through the bottom wall 32 of the base member receives the threaded nipple portion of a stuffing gland fitting 38, through which a suitable, waterproof electrical cable 40 passes into the interior of the fixture 10 for carrying electrical current to the lamp assembly about to be described. The stuffing gland fitting 38 is of conventional construction and permits the fixture 10 to be carried to substantial water depths without intrusion of moisture. An opening 42 in plate 34 accommodates the gland fitting 38 and wire 40.

Within the cavity 18 of the base member 12 and extending upwardly from the bottom wall 32 thereof, are a pair of vertical, laterally spaced parallel rods or bars 50, the lower ends of which are threadedly fixed in the base member as shown at 52. Across the upper ends of the bars 50, is a horizontal metal disc or plate 54 that supports an electrical lamp socket 58, conveniently secured to the plate and, in this example, is of the type adapted to receive a lamp 62 having a screw base of a size known in the art as a miniature candelabra. The lamp 62 is preferably a 150 watt tungsten-halogen lamp.

Extending upwardly from the plate 54 are a pair of laterally spaced parallel rods or bars 64 that are in axial alignment with the bars 50. Threaded studs 66 extend from the bars 64 through openings in the plate 54 and into the upper ends of the bars 50. The bars 64 and 50 are thereby held in tight, clamping relation to the plate 54.

Across the upper ends of the bars 64 is a metal heat collector or heat sink, indicated generally at 70 and comprising a disc shaped horizontal plate portion 72 and a plurality of vertical fins 74. The plate portion 72 is clamped tightly to the upper ends of the bars 64, as by cap screws 76 extending through the plate portion and into the bars. The fins 74 are arcuate so that the peripheries thereof follow closely and are substantially equally spaced from the inner hemispherical surface of the upper end of the globe 20.

Mounted on the underside of the heat sink plate portion 72 is a lamp socket 78 that is like socket 58 and is secured by screws 80. A lamp 82, of the same type as lamp 62, is mounted in the socket 58.

Extending between the plate 54 and plate portion 72 is a curved reflector 86. The reflector 86 is cylindrical at the end portions which fit neatly around the sockets 58 and 78, and comprises a substantially semi-cylindrical middle portion behind the lamps 62 and 82.

The sockets 58 and 78 are supplied with electrical current for energization of the respective lamps via the cable 40, conductors of which are led upwardly through an opening 90 in plate 54, through a notch in the bottom end of the reflector 86 and into the base of socket 58. Part of the cable 40 also is led upwardly behind the reflector 86 and into the base of the socket 78, the sockets being electrically connected in parallel. Of course the electrical insulation material of cable 40 is advantageously of a type intended for use in high temperature environments.

MODE OF OPERATION

Figure 5:
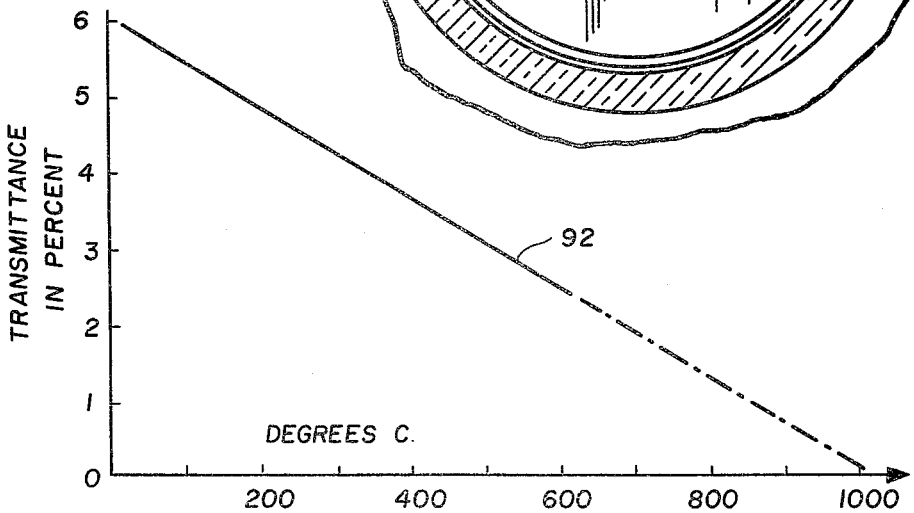
FIG. 5 is a graphic illustration depicting percentage of light transmittance versus temperature for a typical red glass globe.

As mentioned in the discussion of the background of the invention, it is characteristic of colored glass globes to decrease somewhat radically in their degree of transmittance of various wavelengths of light energy with increases in temperature. The reduction in transmittance with increases in temperature is especially noted in the case of red globes. Referring to FIG. 5, the curve 92 is representative of actual data taken from room temperature up through 600° C., and it will be noted that at 600° C. the transmittance is reduced to only about 2.5% as compared to about 6% at room temperature. The curve 92 is substantially straight and would seem to go to zero transmittance at about 1000° C.

Experiments have shown that with the available 150 watt tungsten-halogen lamps, using appropriate reflectors, a globe temperature of no more than 400° C. can be tolerated to achieve the intensity of light output required to satisfy regulations.

To this end, the heat collector or sink 70, in combination with the bars 64, 50, and the finned base 12, serves to prevent a build-up of heat in the air in the upper regions of the interior of the fixture 10, which build-up would result in a concomittant rise in temperature of the globe 20 above the temperature of satisfactory light transmittance. Thus, the bars 64, 50 serve as heat conducting column means operatively interconnecting the heat collector 70 and the base member 12. It should be noted that the fins of the heat collector 70 serve to extract heat from the surrounding air rather than to dissipate heat into the air as is generally the case with finned heat transfer devices.

In addition to the base 12, all of the heat conductive elements of the combination, including the heat collector or sink 70, the bars 64, 50, and the nut 22, are made of a suitable heat conductive metal such as aluminum. Of course other heat conductive metals such as brass can also be used. It is also advantageous to provide the surfaces of such elements with a black finish, such as black anodizing, to improve heat absorption and/or radiation capabilities thereof.

Obviously, other embodiments and modifications of the subject invention will readily come to the mind of one skilled in the art having the benefit of the teachings presented in the foregoing description and the drawing. It is, therefore; to be understood that this invention is not to be limited thereto and that said modifications and embodiments are intended to be included within the scope of the appended claims.

What is claimed is:

1. A watertight light fixture for use in preventing collision at sea, said light fixture comprising:

a rigid metal base member adapted to be mounted on a ship or vessel;

a hollow glass globe formed with a closed upper end portion and an open lower end, said globe having light transmissivity characteristics that vary in amount and chromaticity with changes of temperature and which lie in predetermind desired ranges only when the temperature of said globe is below a predetermined temperature;

means, cooperating with said globe and said base member, for securing said open end of said globe against said base member in a direct heat transferring relation thereto;

incandescent lamp means, disposed within said globe, for emanating light energy including light within said predetermined range of chromaticity;

heat collector means, disposed within the upper region of said globe and adjacent to the inner surface of said closed upper end portion of said globe, for extracting thermal energy therefrom; and heat conductor means, connected between said heat collector means and said base member, for transferring said thermal energy to said base member for dissipation to a cooler ambient medium, whereby said globe is maintained below said predetermined temperature.

2. A light fixture as defined in claim 1 and wherein said heat collector means is formed of a rigid, thermally conductive metal and comprises:

a horizontal plate portion;

a plurality of heat collecting fins extending upwardly from said plate portion, the free edge of each of said fins running in closely spaced relation to said interior surface of said closed upper end portion of said globe.

3. A light fixture as defined in claim 2, and wherein:

said heat conductor means comprises pillar means rigidly supporting said plate portion in spaced relation to said base member, said pillar means being rigidly fixed to said base member; and said incandescent lamp means being disposed between said plate portion and said base member.

4. A light fixture as defined in claim 3 and further comprising:

lamp support means fixed to said pillar means; and lamp socket means mounted on said support means;

said incandescent lamp means being mounted in said socket means.

5. A light fixture as defined in claim 4, and further comprising:

reflector means disposed between said plate portion and said lamp support means and operative to redirect a portion of said light energy from said lamp means through said globe.

6. A light fixture as defined in claim 5, and wherein:

said globe comprises an outwardly directed flange around said open end; and said means for securing said open end of said globe to said base member comprises an annular nut surrounding said flange and threadedly engaging said base member.

7. A light fixture as defined in claim 6, and wherein said base member comprises:

external heat radiating fins;

an opening for accommodating electrical cable means for energizing said lamp means; and gland means in said opening for effecting a watertight seal between said cable means and said base member.

8. A navigation light fixture including a heat conductive metal base, a dome-shapted globe of colored glass mounted on said base, and a high intensity incandescent lamp disposed within said globe, wherein the improvement comprises:

a heat collector disposed in said globe and adjacent to the inner surface of the upper portion thereof;

heat conductive column means supporting said heat collector relative to said base and operative to conduct thermal energy from said collector to said base; and said base comprising heat dissipating fins thereon for effecting transfer of said thermal energy to ambient air, whereby said glass globe is maintained at a temperature below a predetermined temperature above which light of predetermined chromaticity characteristics that is transmitted through said globe from said lamp is reduced below a predetermined critical value.

9. A navigation light fixture as defined in claim 8, and wherein:

said globe comprises a hemispherical upper end wall; and said heat collector comprises a plurality of spaced, parallel fins the peripheries of which are curved to lie in substantially uniformally spaced relation to the inner surface of said hemispherical upper end wall.

10. A navigation light fixture as defined in claim 9, and further comprising:

a nut member comprising a plurality of heat dissipating fins, said nut member securing said globe to said base and operative to conduct thermal energy from the lower portion of said globe to ambient air portion of said globe to ambient air and to said base.

* * * * *